US009419341B2

(12) United States Patent
Jafarlou et al.

(10) Patent No.: US 9,419,341 B2
(45) Date of Patent: Aug. 16, 2016

(54) RF SYSTEM-IN-PACKAGE WITH QUASI-COAXIAL COPLANAR WAVEGUIDE TRANSITION

(71) Applicant: Peraso Technologies, Inc., Toronto (CA)

(72) Inventors: Saman Jafarlou, Toronto (CA); Mohammad Fakharzadeh, Toronto (CA)

(73) Assignee: Peraso Technologies Inc., Toronto (CA)

( * ) Notice: Subject to any disclaimer, the term of this patent is extended or adjusted under 35 U.S.C. 154(b) by 178 days.

(21) Appl. No.: 14/217,682

(22) Filed: Mar. 18, 2014

(65) Prior Publication Data

US 2015/0270616 A1 Sep. 24, 2015

(51) Int. Cl.
*H01Q 13/02* (2006.01)
*H01P 5/107* (2006.01)

(52) U.S. Cl.
CPC ..... *H01Q 13/02* (2013.01); *H01P 5/107* (2013.01); *H01Q 13/0283* (2013.01); *Y10T 29/49018* (2015.01); *Y10T 29/49165* (2015.01)

(58) Field of Classification Search
CPC ..... H01Q 13/02; H01Q 13/0283; H01Q 5/00; H01Q 5/107
USPC ..... 343/786, 772, 778; 333/21 R, 26, 247, 333/250
See application file for complete search history.

(56) References Cited

U.S. PATENT DOCUMENTS 4,562,416 A * 12/1985 Sedivec ..... H01P 5/107 333/246
6,087,907 A * 7/2000 Jain ..... H01P 5/107 333/246
8,576,023 B1 * 11/2013 Buckley ..... H01P 3/121 333/26
9,178,260 B2 * 11/2015 Biglarbegian ..... H01P 5/107
2003/0137465 A1 * 7/2003 Graczyk ..... H01P 1/042 343/772
2003/0231078 A1 * 12/2003 Koriyama ..... H01L 23/66 333/26
2004/0041651 A1 * 3/2004 Shono ..... H01P 5/107 333/26
2004/0155723 A1 * 8/2004 Koriyama ..... H01L 23/66 333/26
2005/0184825 A1 * 8/2005 Oran ..... H01L 23/66 333/33
2011/0140799 A1 * 6/2011 Biran ..... H01P 3/121 333/26
2013/0057358 A1 * 3/2013 Anthony ..... H01P 5/107 333/26
2013/0162366 A1 * 6/2013 Essenwanger ..... H01P 5/028 333/26
2013/0214871 A1 * 8/2013 Nakamura ..... H01P 1/16 333/26

* cited by examiner

*Primary Examiner* — Dameon E Levi
*Assistant Examiner* — Ab Salam Alkassim, Jr.

(57) ABSTRACT

An IC package includes an IC die disposed at a first surface of a substrate, which includes a signal via extending between first and second metal layers. The first metal layer is proximate to the first surface and includes a first coplanar waveguide. The first coplanar waveguide has a first signal line coupling a die bump to the signal via and has a first ground plane co-planar with the first signal line. The second metal layer is proximate to a second surface and includes a second coplanar waveguide that has a second signal line coupling the signal via to a launcher element and has a second ground plane co-planar with the second signal line. The IC package further includes a waveguide channel aperture comprising a region surrounding the launcher element and which is substantially devoid of conductive material and a via fence disposed at a perimeter of the first region.

16 Claims, 10 Drawing Sheets

RF SYSTEM-IN-PACKAGE WITH QUASI-COAXIAL COPLANAR WAVEGUIDE TRANSITION

CROSS-SECTION TO RELATED APPLICATIONS

The present application is related to the following co-pending applications, the entireties of which are incorporated by reference herein:

U.S. patent application Ser. No. 14/217,683, entitled "Waveguide Adapter Plate to Facilitate Accurate Alignment of Sectioned waveguide Channel in Microwave Antenna Assembly" and filed on even date herewith; and U.S. patent application Ser. No. 14/217,684, entitled "Coplanar Waveguide Implementing Launcher and Waveguide Channel section in IC Package Substrate" and filed on even date herewith;

FIELD OF THE DISCLOSURE

The present disclosure relates generally to antennas and radio frequency (RF) signaling and more particularly to coplanar waveguides.

BACKGROUND

Microwave radio frequency (RF) transmission systems typically are point-to-point, and thus often utilize waveguide channels to focus, or restrict, the direction of propagation of the electromagnetic (EM) signaling to a desired direction. Coplanar waveguides (CPWs) often well suited to integrated microwave or other RF applications due to their relatively high field confinement that reduces interference with other signal traces and unwanted couplings. Conventional implementations facilitate the transition from a CPW to a waveguide channel by inserting a launcher element (also often called a probe element) into a monolithically-formed waveguide channel through an aperture in a transverse wall of the monolithic waveguide channel near the closed end of the monolithic waveguide channel, which then acts to either to focus EM signaling emitted by the feedline or to focus received EM signaling to the feedline. Impedance matching is achieved by shorting a back wall of the waveguide channel proximate to the launcher element within a quarter-wavelength of the EM signaling of the back wall. In some conventional approaches, this spacing is achieved by partially filling the back of the monolithic waveguide channel with dielectric material and then inserting the launcher element. However, errors in the fabrication of the CPW and launcher element or misalignment when inserting the launcher element into the monolithic waveguide can result in erroneous positioning of the launcher element relative to the back wall, and thus can degrade the performance of the CPW-to-waveguide-channel transition. The impact of such fabrication and assembly errors is particularly manifest in systems intended for communicating millimeter-wave (mmW) frequencies of 30 gigahertz (GHz) and higher due to the relatively tight design tolerances for such systems.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
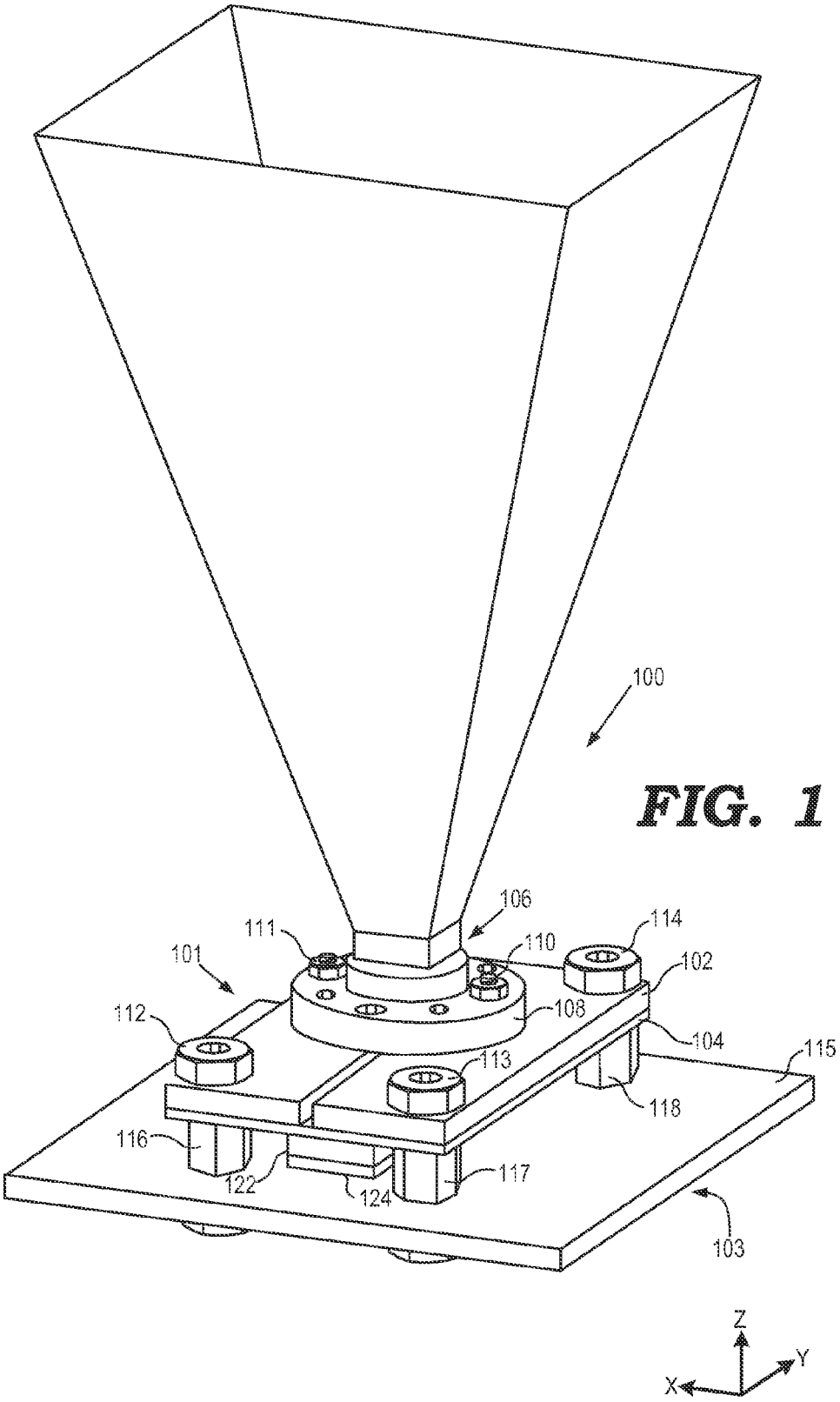
FIG. 1 is a perspective view of a microwave radio frequency (RF) antenna assembly in accordance with some embodiments of the present disclosure.

The following description is intended to convey a thorough understanding of the present disclosure by providing a number of specific embodiments and details involving the fabrication and use of a radio-frequency (RF) antenna assembly implementing a coplanar waveguide (CPWs) and an RF system-in-package (SIP) device or other IC package. It is understood, however, that the present disclosure is not limited to these specific embodiments and details, which are examples only, and the scope of the disclosure is accordingly intended to be limited only by the following claims and equivalents thereof. It is further understood that one possessing ordinary skill in the art, in light of known systems and methods, would appreciate the use of the invention for its intended purposes and benefits in any number of alternative embodiments, depending upon specific design and other needs. Moreover, unless otherwise noted, the figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the disclosed embodiments.

FIGS. 1-10 illustrate example microwave antenna assemblies, waveguide adapter plates, RF IC packages, and methods of their operation and fabrication. In some embodiments, a microwave antenna assembly includes an RF circuit package, such as a system-in-package (SIP) or other integrated circuit (IC) package mounted at one surface of a waveguide adapter plate, which in turn is mounted to the flange of a horn antenna or other antenna on the opposite surface. The waveguide adapter plate comprises a waveguide flange interface having a waveguide channel section that extends from one surface of the waveguide adapter plate to an opposing surface. This waveguide channel section forms an intermediate, or middle, section of a sectioned waveguide channel. The metal layers and certain metal vias of the substrate of the RF circuit package together effectively form a feedline-to-waveguide-channel transition that includes both a proximal section of the sectioned waveguide channel and a feedline that transitions to a launcher element within the proximal section of the waveguide channel. A metal layer of the RF circuit package implementing a ground plane also serves as the back wall of the sectioned waveguide channel. The waveguide adapter plate and the RF circuit device are configured such that when the RF circuit device and waveguide adapter plate are appropriately mated and attached, a waveguide channel aperture of the distal waveguide channel section at the surface of the waveguide adapter plate facing the RF circuit package aligns with a waveguide channel aperture in the metal layers that surround the launcher element (also known as a "probe" or "probe element"). Accordingly, when combined, the waveguide adapter plate and the RF circuit package together form a shorted waveguide channel with a "planar" feedline-to-waveguide-channel transition (that is, a feedline-to-waveguide-channel transition implemented in the plane represented by the substrate).

In this approach, the thickness of the substrate between the ground plane and the top metal layer implementing the launcher element defines the distance between the launcher element and the "back wall" (i.e., the ground plane) of the waveguide channel. Thus, because the substrate can be readily fabricated to very tight tolerances, a quarter-wavelength distancing of the launcher element and the "back wall" can more reliably be achieved, and thus more reliably providing suitable impedance matching characteristics. As described below, testing of an apparatus fabricated in accordance with the teachings below has demonstrated a bandwidth of at least 13 GHz around a 60 GHz center frequency.

To facilitate implementation of a minimal form factor for the antenna subassembly implementing the RF circuit package and the waveguide adapter plate, in some embodiments the RF circuitry of the RF circuit package is implemented in one or more IC die that are disposed on a surface of the substrate of the RF circuit package opposite the waveguide adapter plate. This enables implementation of a substrate no larger in the lateral dimensions than the waveguide adapter plate, as well as enabling implementation of a simplified waveguide adapter plate that does not need to accommodate for the presence of IC die and associated conductive traces on the surface of the substrate facing the waveguide adapter plate.

As the proximal, or end, waveguide channel section of the RF circuit package, the intermediate waveguide channel section of the waveguide adapter plate, and the distal portion of the waveguide channel of the antenna flange together form a continuous waveguide channel from the RF circuit substrate up through the antenna flange, it typically is important for effective operation that these three waveguide channel sections be accurately aligned. To this end, in at least one embodiment, the waveguide adapter plate and the RF circuit package each implements a corresponding set of flange mounting holes that are compatible with, or otherwise correspond to, flange mounting holes in the mounting flange of the antenna, which may be based on, for example, any of a variety of standardized waveguide flange dimension specifications. An antenna subassembly comprising the RF circuit package, the waveguide adapter plate, and the antenna thus may be fabricated by assembling these components together through flange mounting bolts that extend from the RF circuit package to the antenna flange through the waveguide adapter plate, and thus permitting accurate alignment of the waveguide channel sections of each of these components through alignment of the components via the bolts and corresponding flange mounting holes in each component. Moreover, in some embodiments, the waveguide adapter plate further implements one or more substrate alignment pins intended to extend into corresponding alignment holes in the substrate of the RF circuit package to assist in the initial alignment and mating of the RF circuit package and the waveguide adapter plate.

While the placement of the IC die generating the RF signal on the surface of the substrate opposite the surface facing the waveguide adapter plate facilitates a smaller form factor and a simplified waveguide adapter plate, this approach causes the source of the RF signal to be transmitted or the destination of a received RF signal (that is, the IC die) to be on the surface of the substrate opposite of the surface at which the launcher element and sectioned waveguide channel are located. Thus, to enable transition of RF signaling between the launcher element at the top metal layer of the substrate and the IC die connected at the bottom metal layer, in at least one embodiment the RF circuit package implements a coplanar waveguide (CPW) transition component comprising one CPW segment at the bottom metal layer, another CPW segment at the top metal layer, and a quasi-coaxial segment that extends through the substrate to connect the two CPW segments. The quasi-coaxial segment comprises a metal via extending from the top metal layer to the bottom metal layer (this via being referred to herein as a "signal via"). The CPW segment at the top metal layer comprises a signal line acting as a feedline coupling the signal via to the launcher element, and further comprises a co-planar ground plane. The CPW segment at the bottom metal layer comprises a signal line that also serves as a feedline coupling the signal via to a pin or other bump of the IC die. Further, a via fence implemented at the perimeter of an a waveguide channel aperture, or open region, around the launcher element in the waveguide channel section of the substrate can extend along regions surrounding the signal lines of the CPW segments and a column region surrounding the signal via of the quasi-coaxial segment so as to enhance the confinement of power and to reduce interference for signals transmitted via the CPW transition component.

For the following, certain features may be depicted in the figures with exaggerated dimensions relative to other features for ease of illustration. To illustrate, the dimensions of vias, conductive traces, and other metal features of a substrate of an RF circuit package described herein may be exaggerated relative to other features of the substrate and other components of the antenna assembly so as to more clearly depict the salient features of such structures. Moreover, certain directional terms, such as "top" and "bottom", are used herein solely with respect to the example or depicted orientation of the corresponding object as depicted in the corresponding figure, and these terms are not intended to imply a particular orientation with respect to a fixed reference in implementation.

FIG. 1 illustrates a perspective view of a microwave antenna assembly 100 in accordance with some embodiments of the present disclosure. The microwave antenna assembly 100 is operated to communicate electromagnetic (EM) signaling on behalf of an associated external signal processing device (not shown). The communication of EM signaling can include wirelessly transmitting signaling (that is, the microwave antenna assembly 100 driving electrical current signaling at RF frequencies to generate the electromagnetic signaling), wirelessly receiving signaling (that is, receiving the electromagnetic signaling from another source and converting it to electrical current signaling for provision to the signal processing device), or both. For ease of illustration, the microwave antenna assembly 100 is described in the example context of millimeter wave (mmW) signaling, and more particularly signaling conducted at a bandwidth having a center frequency of around 60 GHz (e.g., 55-65 GHz), as may be in found in small cell backhaul systems for wireless cellular networks. However, the described herein are not limited to this context, but instead may be utilized for communicating signaling at frequencies for which waveguides can be implemented.

In the depicted example, the microwave antenna assembly 100 includes an antenna subassembly 101 mounted to a base assembly 103. The base assembly can comprise, for example, a printed circuit board (PCB), such as an evaluation board or an operational PCB intended for field deployment. Alternatively, the base assembly 103 may comprise a backing plate or other mounting surface of a field-deployed system, such as a mounting bracket located on a cellular transmission tower. For ease of illustration, embodiments of the microwave antenna assembly 100 in an example context of the base assembly 103 as an evaluation board are described herein.

The antenna subassembly 101 comprises a waveguide adapter plate 102, an RF system-in-package (SIP) 104 (also referred to herein as RF circuit package 104), and a horn antenna 106 or other suitable antenna. The horn antenna 106 and waveguide adapter plate 102 may be composed of one or more metals or other conductive materials, such as one or a combination of aluminum (Al), copper (Cu), nickel (Ni), gold (Au), silver (Ag), brass, steel, or other metals or metal alloys, as well as layers or platings of different metals or metal alloys.

As illustrated, an antenna flange 108 is mounted to the top surface of the waveguide adapter plate 102 and the RF circuit package 104 is mounted to the bottom surface of the waveguide adapter plate 102 ("top" and "bottom" being relative to each other and relative to the view presented by FIG. 1 or other corresponding figure, and not specifying a particular relationship with respect to a gravitational direction). As described in greater detail below, the antenna flange 108, waveguide adapter plate 102, and RF circuit package 104 maybe aligned and assembled together to form the antenna subassembly 101 via the use of flange bolts, such as flange bolts 110, 111, extending through corresponding flange mounting holes in each of the antenna flange 108, waveguide adapter plate 102, and RF circuit package 104. Alternatively, any of a variety of fastening mechanisms, such as clamps, press-fit pins and corresponding pin holes, elastic bands, and the like, may be used to secure the antenna flange 108, RF circuit package 104, and waveguide adapter plate 102 together in the intended orientation. As also described below, the alignment afforded by the flange bolts and corresponding flange mounting holes facilitates the alignment of corresponding waveguide channel sections in each of the RF circuit package 104, waveguide adapter plate 102, and antenna flange 108 so as to form a substantially continuous sectioned waveguide channel that extends between a bottom ground plane in the RF circuit package 104 up through the antenna 106.

The antenna subassembly 101 in turn is mounted to the base assembly 103 using, for example, mounting bolts, such as mounting bolts 112, 113, 114, that extend from a top surface 115 of the base assembly 103 and through corresponding mounting holes in each of the RF circuit package 104, waveguide adapter plate 102, and antenna flange 108. Further, spacers, such as spacers 116, 117, and 118, may be used in conjunction with the mounting bolts to maintain the antenna subassembly 101 at a desired offset from the surface 115 of the base assembly 103. Alternatively, any of a variety of fastening mechanisms may be used to secure the antenna subassembly 101 to the base assembly 103. When mounted to the base assembly 103, an electrical connector 122 disposed at a bottom surface of the RF circuit package 104 couples with a compatible electrical connector 124, and when so coupled, the electrical connectors 122 and 124 together operate to conduct signaling and power between the RF circuit package 104 and circuitry of the base assembly 103 or other circuitry via the electrical connector 124.

Figure 2:
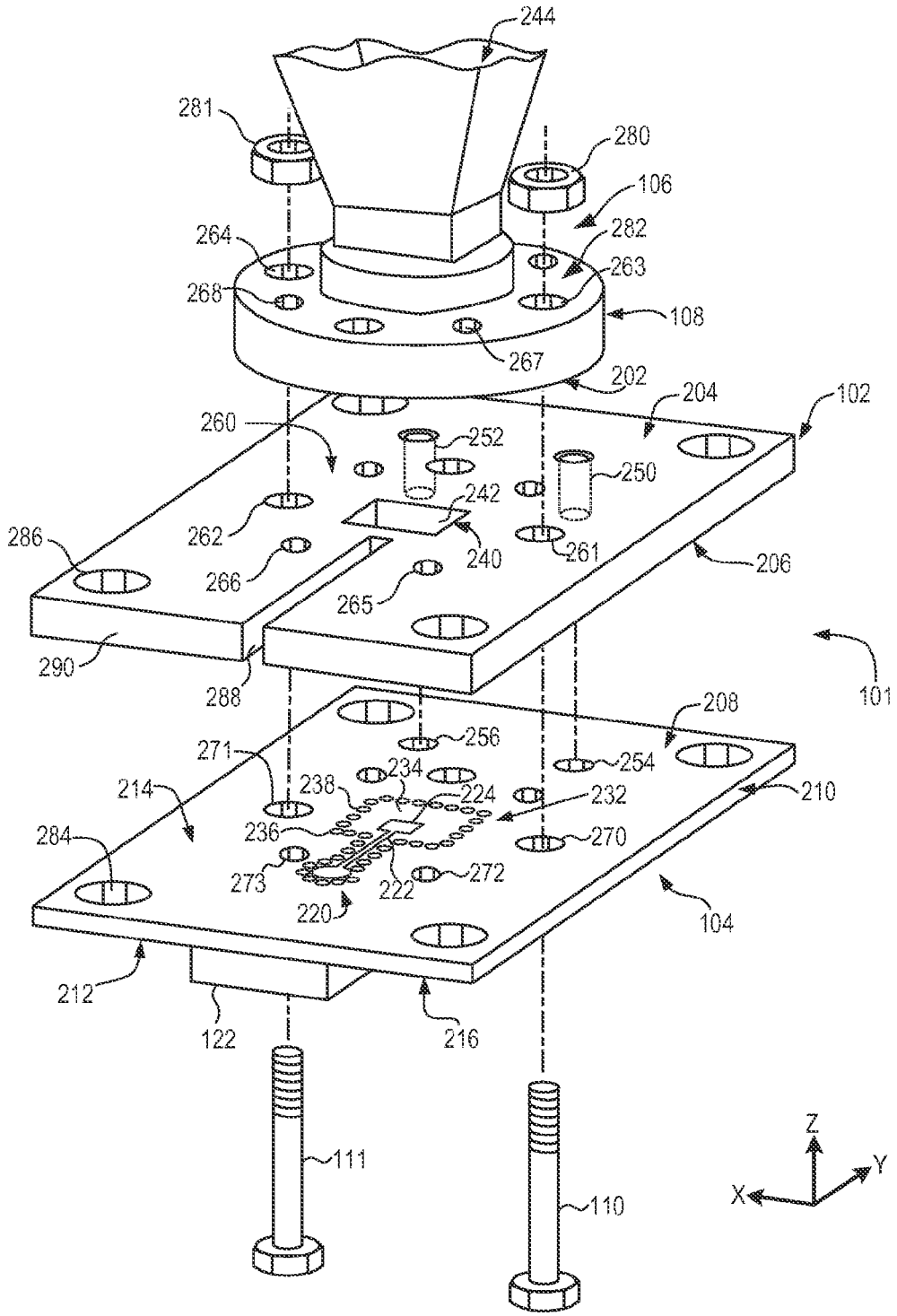
FIG. 2 is a perspective view of a process for assembling an antenna subassembly of the microwave antenna assembly of FIG. 1 in accordance with some embodiments.

FIG. 2 illustrates an exploded perspective view of the antenna subassembly 101 of FIG. 1 in accordance with at least some embodiments. As noted above, the antenna subassembly 101 comprises mounting the antenna flange 108 and the RF circuit package 104 to the waveguide adapter plate 102 such that a bottom surface 202 of the antenna flange 108 faces or otherwise abuts a top surface 204 of the waveguide adapter plate 102 and such that a bottom surface 206 of the waveguide adapter plate 102 faces or otherwise abuts a top face 208 of the RF circuit package 104.

In the depicted example, the RF circuit package 104 is implemented as a system-in-package (SIP) comprising an integrated circuit (IC) die (not shown in FIG. 2, see, e.g., IC die 420 of FIG. 4) and other circuit components disposed at a substrate 210. The IC die is disposed at a bottom surface 212 of the substrate 210 and implements circuitry for a radio and baseband system to provide RF transmission functionality, RF reception functionality, or both. The IC die can be implemented as, for example, a controlled collapse chip connection (C4)(also known as a "flip chip") whereby solder balls or other bumps are used to connect input/output (I/O) to corresponding bump pads of the substrate 210, a wirebonded die, and the like. The RF circuit package 104 also may include external circuit components disposed at the bottom surface 212 to support the operation of the IC die. To illustrate, the RF circuit package 104 can include a crystal oscillator and one or more discrete resistor and capacitors (not shown) disposed at the bottom surface 212. The electrical connector 122 likewise is mounted at the bottom surface 212 of the substrate 210.

The substrate 210 implements at least two metal layers (also referred to as metallization layers) separated by dielectric layers. These metal layers include a top metal layer 214 at, or proximate to, the top surface 208 of the substrate 210 and a bottom metal layer 216 at, or proximate to, a bottom surface 212 of the substrate 210. The bottom metal layer 216 implements the conductive traces used to connect the electrical connector 122 to various pins of the one or more IC dice. The metal layers of the substrate 210 further may include one or more intermediary metal layers to provide conductive traces for signal routing among the electrical connector 122, the IC die, and the other various circuit components of the substrate 210.

Further, the metal layers of the substrate 210 implement a waveguide 220 comprising a feedline 222 terminating or otherwise coupled to a launcher element 224 for transmitting RF signaling from the IC die or receiving RF signaling for the IC die. As the launcher element 224 and feedline 222 are disposed at the top metal layer 214 while the IC device is connected via the bottom metal layer 216, in at least one embodiment waveguide 220 comprises a coplanar waveguide (CPW) structure (see, e.g., CPW structure 300 of FIGS. 3-7) that operates as a continuous conductive element to conduct RF signaling between a pin or other bump of the IC die connected to the bottom metal layer 216 and the launcher element 224 implemented in the top metal layer 214; that is, the CPW structure operates as a through-substrate feedline-to-waveguide-channel launcher transition. The CPW device is described in greater detail below with reference to FIGS. 3-9.

In at least one embodiment, the launcher element 224 is implemented as a feed-line-to-waveguide channel transition for a sectioned waveguide channel (see sectioned waveguide channel 708 of FIG. 7) formed from corresponding sequence of waveguide channel sections in each of the RF circuit package 104, waveguide adapter plate 102, and antenna 106. A proximal waveguide channel section 232 ("proximal" being relative to the launcher element 224 in this case) is formed in the substrate 210 by configuring the metal layers of the substrate 210 to form an open region 234 surrounding the launcher element 224, whereby the region 234 forms a cavity extending up from the bottom metal layer 216 through the top metal layer 214 which is substantially devoid of conductive material (e.g., by creating coaxial waveguide channel apertures in the intermediary metal layers and top metal layer 214) and such that the bottom metal layer 216 acts as a ground plane under this region 234. Further, the substrate 210 includes a via fence 236 formed from a plurality of metal vias 238 extending from a ground plane in the top metal layer 214 to a ground plane in the bottom metal layer 216 and which are disposed around or otherwise define the perimeter of the region 234 below the launcher element 224. Thus, the corresponding portion of the ground plane below this region 234 effectively serves as the "back wall" of the proximal waveguide channel section 232 and the metal vias of the via fence 236 effectively serve as the "side walls" and waveguide opening for the proximal waveguide section 232.

The waveguide adapter plate 102 implements an intermediary waveguide channel section 240 extending between a waveguide channel aperture 242 at the top surface 204 and a waveguide channel aperture (not shown in FIG. 2) at the bottom surface 206 of the waveguide adapter plate 102. Similarly, the antenna flange 108 implements a distal waveguide channel section (not shown in FIG. 2) extending from a waveguide channel aperture at the bottom surface 202 into the interior 244 of the horn antenna 106. In at least one embodiment, the waveguide channel sections of the RF circuit package 104, waveguide adapter plate 102, and antenna flange 108 are configured such that when these components are assembled in the manner illustrated in FIG. 1, the waveguide channel sections abut and align to form a substantially continuous sectioned waveguide channel (see sectioned waveguide channel 708 of FIG. 7) that extends from a ground plane at the bottom metal layer 216 of the substrate 210 as the "back wall" through the substrate 210, the waveguide adapter plate 102, and the antenna flange 108 to an opening in the interior 244 of the horn antenna 106, with the via fence 236 and the metal material of the waveguide adapter plate 102 and antenna flange 108 in the waveguide channel sections forming the "sidewalls" of the waveguide channel. As many semiconductor fabrication processes can control the layer dimensions of the substrate 210 to tight dimensional tolerances, this arrangement permits the launcher element 224 to be accurately located an appropriate distance from the effective "back wall" and "side walls" for an intended center frequency with reduced opportunity for fabrication error or assembly misalignment and thus more reliably providing the appropriate shorting between the probe element and the waveguide at the intended center frequency.

The proximal, intermediary, and distal waveguide channel sections are compatibly located and dimensioned in their respective components of the antenna subassembly 101 so as to facilitate formation of the substantially continuous and uniform sectioned waveguide channel when the antenna subassembly 101 is assembled as shown. To illustrate, the dimensions of each waveguide channel section may be designed so as to comply with any of a variety of waveguide standards, such as the Electronic Industries Alliance (EIA) WR waveguide standards or the Radio Components Standardization Committee (RCSC) WG waveguide standards. For illustrative purposes, the waveguide channel is illustrated and described herein as a WR-15 compliant waveguide with sharp corners. However, in implementation, it may be more cost-effective to form the waveguide channel sections with rounded corners, which the inventors have found does not materially impact the performance of the resulting sectioned waveguide channel.

As proper alignment of the waveguide channel sections is important in forming a substantially continuous and waveguide channel between the substrate 210 and the horn antenna 106, in at least one embodiment the antenna subassembly 101 incorporates various mechanisms to facilitate this proper alignment during assembly. In one embodiment, the waveguide adapter plate 102 implements one or more substrate alignment pins, such as alignment pins 250, 252, that extend substantially perpendicular from the bottom surface 206. The RF circuit package 104, in turn, implements one or more corresponding alignment holes, such as alignment holes 254, 256 that are positioned and dimensioned to be compatible with the dimensions and corresponding locations of the substrate alignment pins on the waveguide adapter plate 102. The substrate alignment pins and corresponding alignment holes may be dimensioned so as to provide a press-fit relationship, thereby helping to bind the RF circuit package 104 to the waveguide adapter plate 102 during assembly, or with a looser relationship so as to more easily permit adjustment of the orientation of the RF circuit package 104 relative to the waveguide adapter plate 102 during assembly. This configuration provides both the benefit of helping to ensure that the RF circuit package 104 is oriented correctly with respect to the waveguide adapter plate 102 during assembly, and the benefit of providing a general alignment of the proximal waveguide channel section 232 formed at the substrate 210 with the intermediary waveguide channel section 240 formed at the waveguide adapter plate 102.

To enable attachment of the antenna flange 108 to the waveguide adapter plate 102, in at least one embodiment, the waveguide adapter plate 102 implements a waveguide flange interface 260 that includes the waveguide channel section 240 and further includes a set of attachment points that serve to electrically and mechanically attach and align the antenna flange 108 to the waveguide adapter plate 102 such that the waveguide channel aperture 242 of the waveguide adapter plate 102 aligns with the waveguide channel aperture at the bottom surface 202 of the antenna flange 108. These attachment points can include, for example, flange bolt holes 261, 262 in the waveguide adapter plate 102 which correspond to flange bolt holes 263, 264, respectively, in the antenna flange 108. These attachment points further can include, for example, flange alignment holes 265, 266 in the waveguide adapter plate 102 corresponding to alignment holes 267, 268, respectively, in the antenna flange 108 and which are to receive dowel pins to facilitate the proper alignment and orientation the antenna flange 108 during attachment. The attachment points and other aspects of the waveguide flange interface 260 can be formed to comply with any of a variety of waveguide flange interface standards, such as an EIA CMR or CPR flange standard, a U.S. military standard MIL-DTL-3922 flange standard, an International Electrotechnical Commission (IEC) standard IEC 60154 flange standard, and the like. As noted above, the depicted waveguide channel section 240 is compliant with the EIA WR15 waveguide standard, and the depicted waveguide flange interface 260 comprises flange bolt holes and alignment holes dimensioned consistent with the UG-385/U modified (MIL-F-3922/67B-08) flange standard.

In at least one embodiment, the antenna subassembly 101 leverages the alignment afforded by the compatible attachment points of the antenna flange 108 and the waveguide flange interface 260 of the waveguide adapter plate 102 to additionally align the RF circuit package 104 with the waveguide adapter plate 102 and the antenna flange 108 such that the waveguide channel sections of each of these components are sufficiently aligned to form an effective sectioned waveguide channel. To this end, the RF circuit package 104 includes flange bolt holes, such as flange bolt holes 270, 271, and flange alignment holes, such as flange alignment holes 272, 273, that are dimensioned and located in the substrate 210 so as to align with the corresponding flange bolt holes and alignment holes of the waveguide adapter plate 102 and the antenna flange 108 when the components of the antenna assembly 101 are properly oriented and assembled, and such that the apertures of the three waveguide channel sections of these components are properly aligned when the flange bolt holes and alignment holes of the RF circuit package 104, waveguide adapter plate 102, and antenna 106 are properly aligned.

To provide the alignment mechanism, and to securely fasten the components together, the antenna subassembly 101 implements one or more flange bolts, such as flange bolts 110, 111, that are inserted through the corresponding flange holes of each of the RF circuit package 104, waveguide adapter plate 102, and antenna flange 108 and tightened down via nuts 280, 281, respectively, at a top surface 282 of the antenna flange 108, such that the flange bolts extend from the bottom surface 212 of the RF circuit package 104 to the top surface 282 of the antenna flange 108 in a manner that compresses the components together and which enables alignment of the components, and thus alignment of the waveguide channel sections of the components.

As illustrated in greater detail below, when assembled into the antenna subassembly 101, the waveguide adapter plate 102 may overlie the feedline 222 in the top metal layer 214 of the substrate 210. To avoid forming a resonant cavity over this signal line, the waveguide adapter plate 102 can comprise a slot 288 that extends from a location proximate to the waveguide channel section 240 to an opposing edge 290 of the waveguide adapter plate 102, and thus forming an open region overlying the feedline 222.

With the antenna subassembly 101 assembled as shown, the antenna subassembly 101 then may be mounted to the base assembly 103 of FIG. 1 using spacers and mounting bolts extending through corresponding mounting holes in the substrate 210 (e.g., mounting hole 284) and in the waveguide adapter plate 102 (e.g., mounting hole 286), as described above with reference to FIG. 1.

Figure 3:
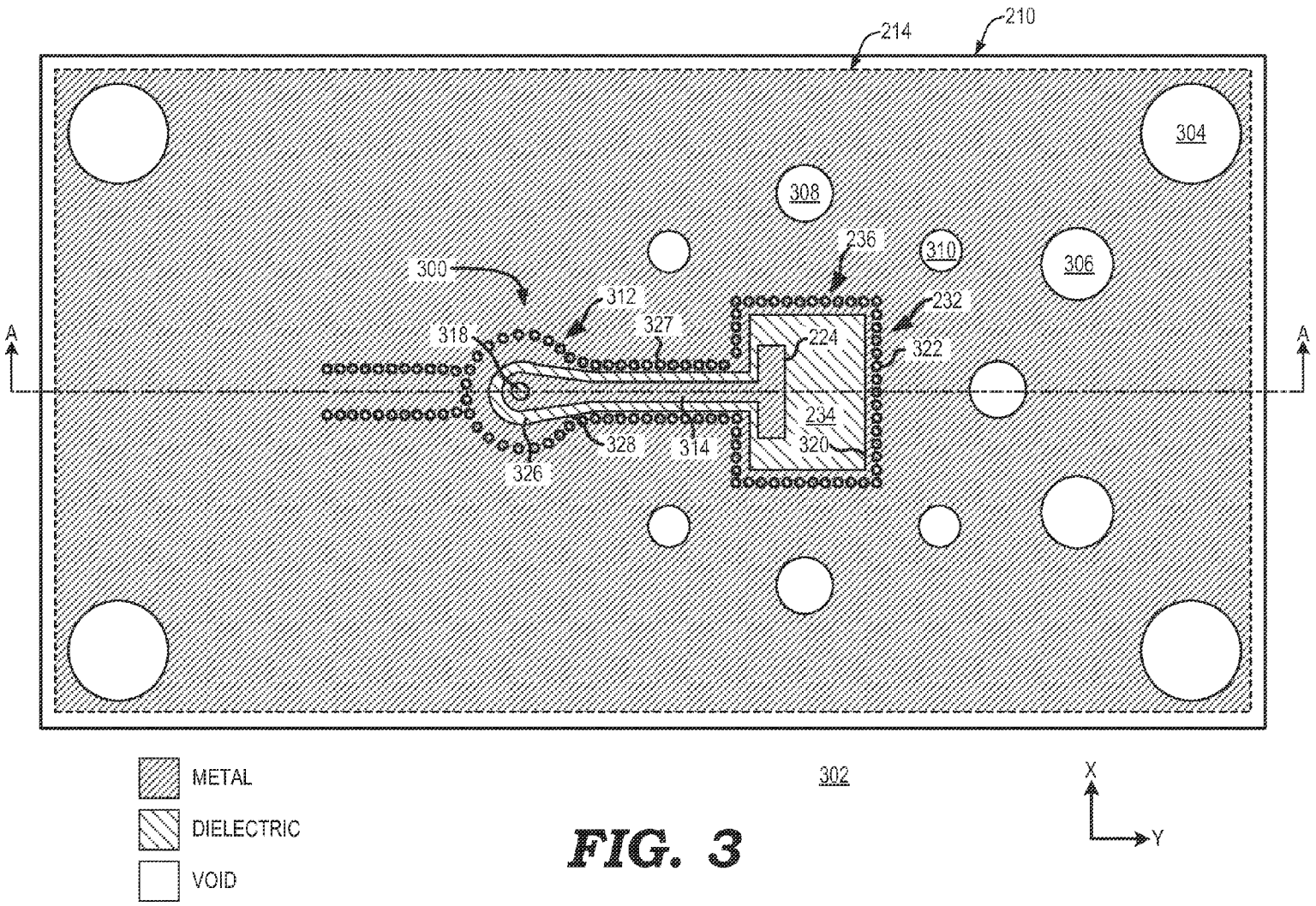
FIG. 3 is a plan view of a top metal layer of a RF integrated circuit (IC) package of the antenna subassembly of FIG. 2 in accordance with some embodiments.
Figure 4:
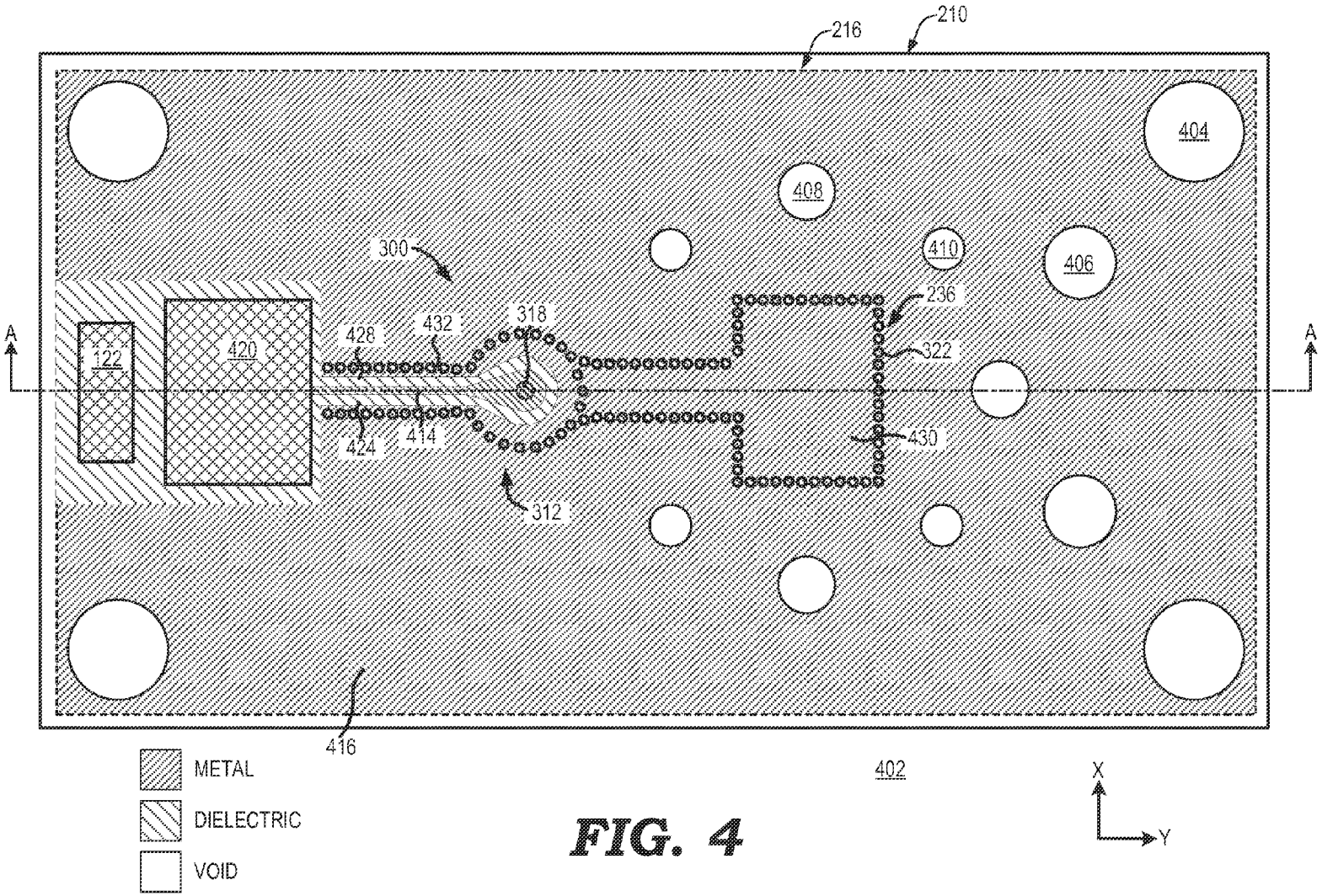
FIG. 4 is a plan view of a bottom metal layer of the RF IC package of the antenna subassembly of FIG. 2 in accordance with some embodiments.
Figure 5:
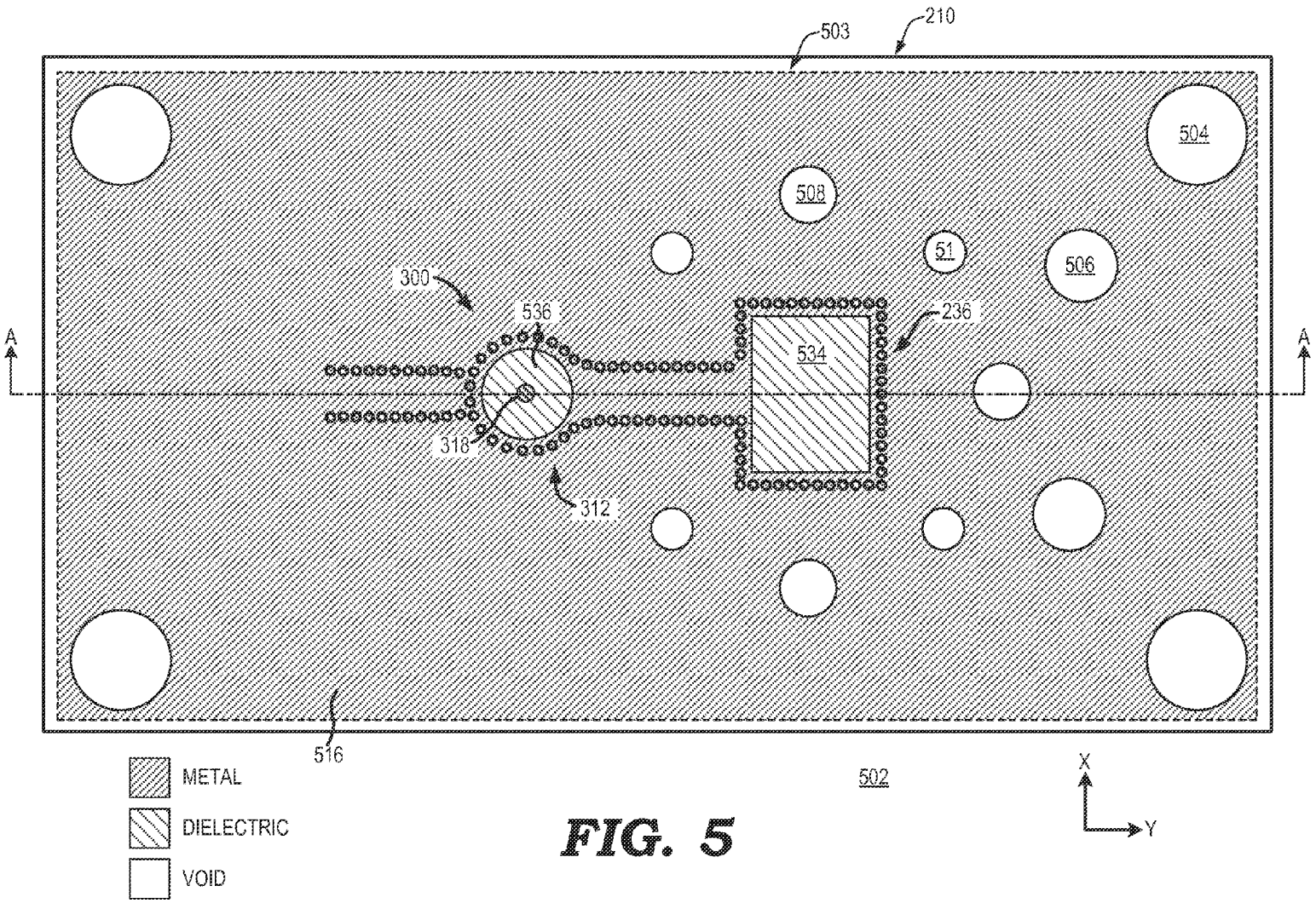
FIG. 5 is a plan view of an intermediary metal layer of the RF IC package of the antenna subassembly of FIG. 2 in accordance with some embodiments.

FIGS. 3-5 illustrate plan views of various metal layers of the substrate 210 of an example implementation of the RF circuit package 104 having the waveguide 220 implemented as a coplanar waveguide (CPW) structure 300. It should be noted that, for ease of illustration, various features of the CPW structure 300 in FIGS. 3-5 are illustrated with enlarged dimensions relative to the substrate 210 and relative to a view of the waveguide adapter plate 102 as presented in FIGS. 6 and 7. As described above, in some embodiments the RF circuit package 104 implements an IC die having the RF circuitry proximally connected to the bottom metal layer 216 at the bottom surface 212 of the substrate 210, whereas the launcher element 224 is implemented at the top metal layer 214 of the substrate 210. The CPW structure 300 thus serves as the conduit by which RF signaling is efficiently communicated between the RF circuitry at the bottom surface 212 and the launcher element 224 (and thus, by extension, the sectioned waveguide channel into which the launcher element 224 extends) through the substrate 210 and across the respective surfaces.

FIG. 3 illustrates a plan view 302 of the top metal layer 214 of the substrate 210. As illustrated, the top metal layer 214 includes void regions 304 corresponding to the positions of the mounting holes (e.g., mounting hole 284, FIG. 2) in the substrate 210, void regions 306 corresponding to the positions of the alignment holes (e.g., alignment holes 254, 256, FIG. 2) in the substrate 210, void regions 308 corresponding to the positions of the flange bolt holes (e.g., flange bolt holes 270, 271, FIG. 2) in the substrate 210, and void regions 310 corresponding to the positions of the flange alignment holes (e.g., flange alignment holes 272, 273, FIG. 2) in the substrate 210.

As illustrated in plan view 302, the CPW structure 300 comprises a quasi-coaxial structure 312, a signal line 314 (one embodiment of the feedline 222 of FIG. 2), the launcher element 224, the waveguide channel section 232, a ground plane 316, and the via fence 236. The waveguide channel section 232 comprises the open region 234 surrounding the launcher element 224, wherein the open region 234 is filled with dielectric material and, with the exception of the launcher 224 and the connecting portion of the signal line 314, is substantially devoid of conductive material and thus includes the illustrated waveguide channel aperture in the top metal layer 214. The perimeter 320 of the region 234 is defined by edges of the ground plane 316. In the illustrated embodiment, the launcher element 224 is depicted as a T-type launcher, as described in greater detail below with reference to FIG. 8. However, other configurations of the launcher element 224 may be implemented, such as the P-type launcher of FIG. 9. The via fence 236 comprises a set of metal vias, such as metal via 322, positioned around the perimeter 320, and which extend from the top metal layer 214 to a ground plane formed at the bottom metal layer 216 (see FIG. 4).

The quasi-coaxial structure 312 comprises a signal via 318 extending between the top metal layer 214 and the bottom metal layer 216. The signal via 318 may be implemented as, for example, a plated through hole or through silicon via (TSV), and may be fabricated in the same process or a different process as the metal vias of the via fence 236. The signal line 314 comprises a conductive trace having one end terminating at the signal via 318 and another end terminating at, or as, the launcher element 224, and thus electrically coupling the signal via 318 and the launcher element 224. The ground plane 316 is co-planar with the signal line 314 and launcher element 224, and is offset from the signal via 318 and signal line 314 by an open region 326 formed of dielectric material and substantially devoid of conductive material. The quasi-coaxial structure 312 further comprises metal vias of the via fence 236, such as metal via 327, that are disposed at the perimeter 328 of the open region 326 formed by edges of the ground plane 316 and which extend from the ground plane 316 to the ground plane formed in the bottom metal layer 216, and which form a "ring" that substantially encircles the signal via 318. As depicted in FIG. 3, the metal vias of the via fence 236 that encircle the signal via 318 form an outer conductive "shield" with the signal via 318 as a centered conductor (that is, the signal via 318 and the encircling metal vias share roughly the same geometric axis), which is similar in appearance to a coaxial cable with its inner conductive wire and outer woven conductive shield. As such, the signal via 318 and the ring of metal vias surrounding the signal via 318 are referred to herein as a "quasi-coaxial" connection or a "quasi-coaxial" CPW segment.

FIG. 4 illustrates a plan view 402 of the bottom metal layer 216 of the substrate 210. As illustrated, the bottom metal layer 216 includes void regions 404 corresponding to the positions of the mounting holes (e.g., mounting hole 284, FIG. 2) in the substrate 210, void regions 406 corresponding to the positions of the alignment holes (e.g., alignment holes 254, 256, FIG. 2) in the substrate 210, void regions 408 corresponding to the positions of the flange bolt holes (e.g., flange bolt holes 270, 271, FIG. 2) in the substrate 210, and void regions 410 corresponding to the positions of the flange alignment holes (e.g., flange alignment holes 272, 273, FIG. 2) in the substrate 210.

As illustrated in plan view 402, at the bottom metal layer 216 the CPW structure 300 comprises the quasi-coaxial structure 312, a signal line 414, a ground plane 416, and the via fence 236. The signal line 414, operating as a feedline, comprises a conductive trace having one end coupled to the signal via 318 and the other end coupled to a bump pad (not shown) coupled to an RF pin or other bump of an IC die 420 (implementing the RF circuitry, as described above), and is substantially surrounded by an open region 424 defined by a perimeter 428 in the ground plane 416 and which is substantially devoid of conductive material. As illustrated, the signal line 414 may be tapered between the region surrounding the signal via 318 and the bump pad of the die so as to facilitate transition to the bump die geometry sizes as well as to provide improved impedance matching. The via fence 236 includes metal vias, such as metal via 432, disposed along the perimeter 428 and which extend from the ground plane 416 to the ground plane 316 (FIG. 3) at the top metal layer 214

As noted above and further illustrated by the plan view 402, certain metal vias (e.g., via 322) of the via fence 236 extend from the perimeter 320 (FIG. 3) in the ground plane 316 of the top metal layer 214 to the ground plane 416 so as to form a ground plane portion 430 that serves as the ground plane and "back wall" of the waveguide channel section 232, and wherein the metal vias at the perimeter 320 (FIG. 3) of the open region 234 (FIG. 3) form the "side walls" of the waveguide channel section 232. As also noted above and further illustrated by plan view 402, metal vias of the via fence 236 substantially encircle a region around the signal via 318 and extend from the ground plane 316 of the top metal layer 214 to the ground plane 416 of the bottom metal layer 216, thus forming a column of metal vias surrounding the signal via 318 as it extends between the two metal layers.

Although FIGS. 3 and 4 (and FIG. 7 below) illustrate an example embodiment whereby the signal line 414 is oriented at an angle of 180 degrees relative to the signal line 314 (that is, the signal lines 314 and 414 run in opposite directions from the signal via 318 in the substrate 210), the signal lines 314 and 414 may be oriented at other angles with respect to the signal via 318. To illustrate, the IC die 420 may be mounted orthogonal to the signal line 314, and thus the signal line 414 may extend from the signal via 318 at a 90 degree angle relative to the signal line 314.

FIG. 5 illustrates a plan view 502 of an intermediary metal layer 503 of the substrate 210. The substrate 210 may implement one or more of such intermediary metal layers 503. As illustrated, the intermediary metal layer 503 includes void regions 504 corresponding to the positions of the mounting holes (e.g., mounting hole 284, FIG. 2) in the substrate 210, void regions 506 corresponding to the positions of the alignment holes (e.g., alignment holes 254, 256, FIG. 2) in the substrate 210, void regions 508 corresponding to the positions of the flange bolt holes (e.g., flange bolt holes 270, 271, FIG. 2) in the substrate 210, and void regions 510 corresponding to the positions of the flange alignment holes (e.g., flange alignment holes 272, 273, FIG. 2) in the substrate 210.

Further, as illustrated by plan view 502, the intermediary metal layer 503 includes a ground plane 516 that defines open regions 534 and 536. The open region 524 surrounds the signal via 318 and, other than the signal via 318, is substantially devoid of conductive material. Similarly, the open region 534 corresponds to the open region 234 in the top metal layer 214 and likewise is substantially devoid of conductive material. Further, the intermediary metal layer 503 includes the metal vias of the via fence 236 disposed at the perimeters of the open regions 534 and 536, as well as at the perimeters of regions corresponding to the open regions in the other metal layers.

Figure 6:
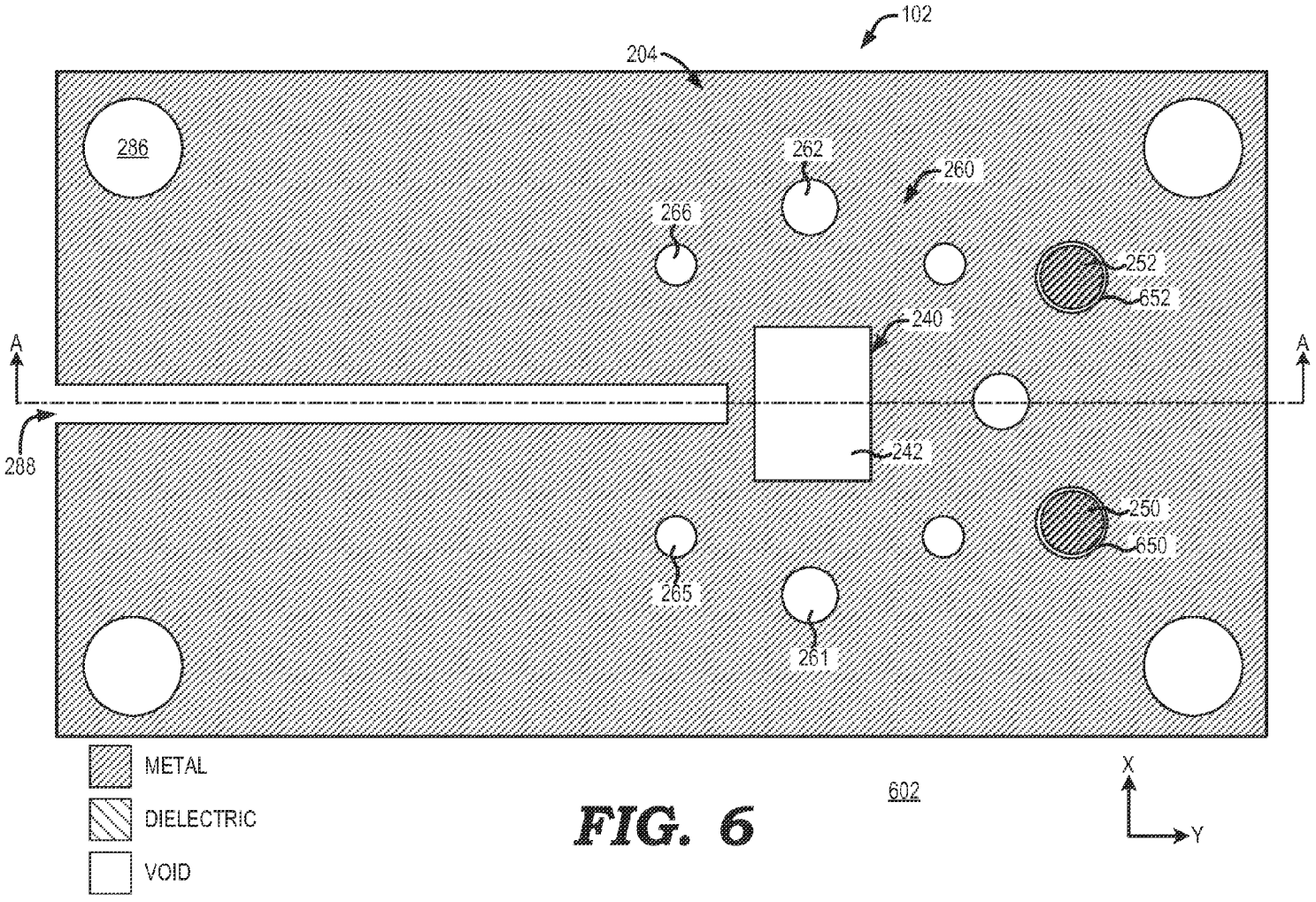
FIG. 6 is a plan view of a top surface of a waveguide adapter plate of the antenna subassembly of FIG. 2 in accordance with some embodiments.

FIG. 6 illustrates a plan view of the top surface 204 of the waveguide adapter plate 102 (FIG. 2) in accordance with at least one embodiment of the present disclosure. As illustrated, the waveguide adapter plate 102 includes mounting holes, such as mounting hole 286, and a waveguide flange interface 260 comprising flange bolt holes, such as flange bolt holes 261, 262, and flange alignment holes, such as flange alignment holes 265, 266, as described above. Further, the waveguide adapter plate 102 includes the waveguide channel section 240 having the waveguide channel aperture 242 at the top surface 204, and wherein the waveguide channel section 240 is aligned with the waveguide channel section 232 of the substrate 210 of the RF circuit package 104 when properly aligned and assembled together. Moreover, the waveguide adapter plate 102 further includes the alignment pins 250, 252, which in the illustrated example comprise press-fit pins or screw-in pins inserted into corresponding holes 650.652 in the waveguide adapter plate 102. Also illustrated is the slot 288 extending from the waveguide channel section 240 to the edge of the waveguide adapter plate 102.

Figure 7:
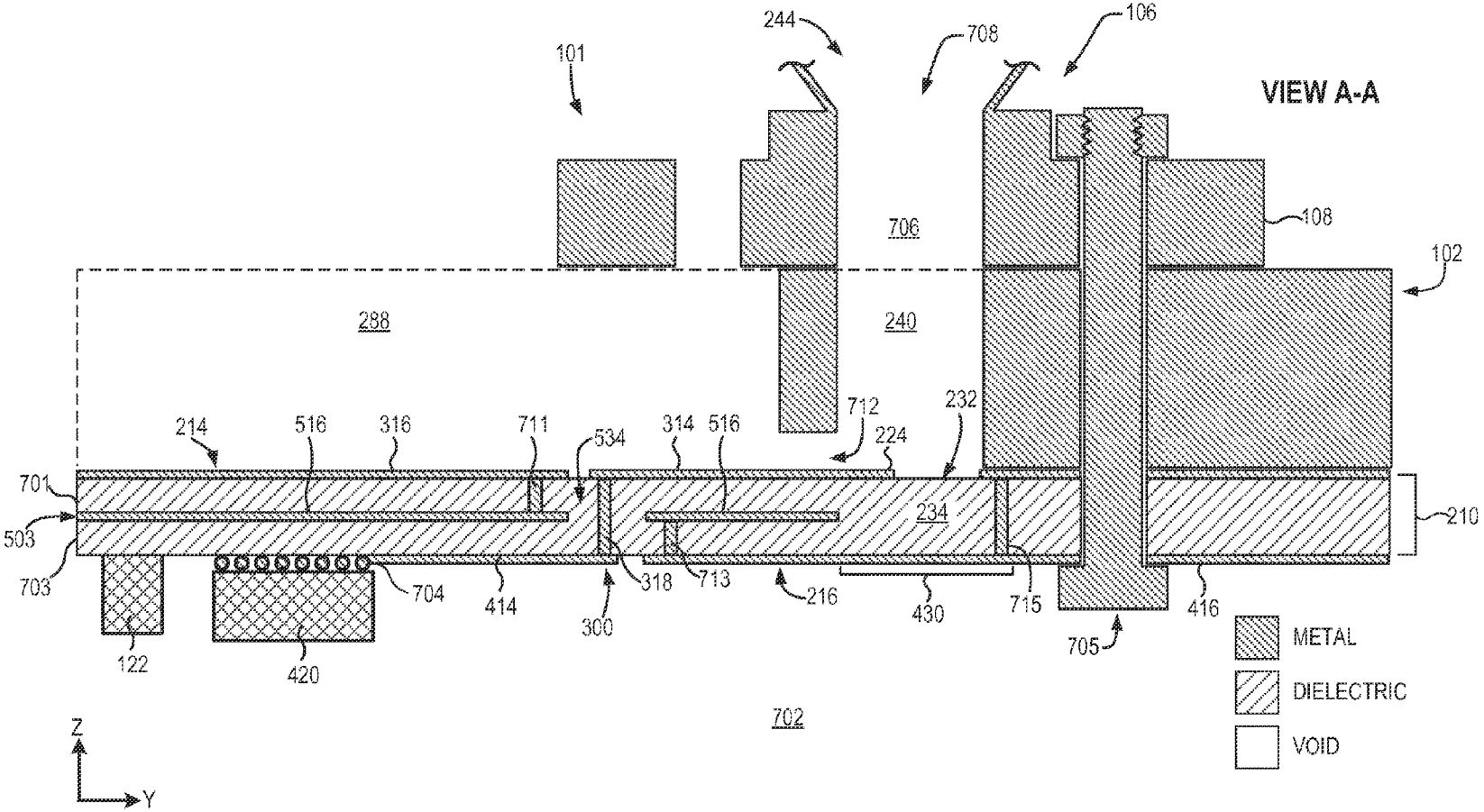
FIG. 7 is a cross-section view of the antenna subassembly of FIGS. 2-7 in accordance with some embodiments.

FIG. 7 illustrates an example cross-section view 702 of the antenna subassembly 101 implementing the RF circuit package 104 with the example substrate 210 having the metal layers as illustrated in FIGS. 3-5 and the example waveguide adapter plate 102 as illustrated in FIG. 6. The cross-section view 702 is provided relative to cross-section line A-A illustrated in each of FIGS. 3-6.

As illustrated by this view, the substrate 210 includes the top metal layer 214, the bottom metal layer 216, and one or more intermediary metal layers 503 interleaved with dielectric layers, such as dielectric layer 701 between the top metal layer 214 and the intermediary metal layer 503 and dielectric layer 703 between the intermediary metal layer 503 and the bottom metal layer 216. The metal layers 214, 216, 503 can comprise any of a variety of metals or metal alloys, or combinations thereof, such as copper (Cu), aluminum (Al), Silver (Ag), gold (Au), nickel (Ni), and the like. The metal layers 214, 216, 503 can be formed, for example, by forming, adhering, or otherwise disposing a metal sheet or foil (e.g., a copper or gold foil) at a surface of the corresponding dielectric layer and then etching or ablating the metal material to define the dimensions of the metal elements of the metal layer as described herein. Alternatively, the metal layers can be formed via a metal deposition or plating process. For example, the metal layers can be formed via a copper damascene process. The dielectric layers 701 and 703 can comprise any of variety of dielectric materials, or combinations thereof, that are suitable for low-loss, high frequency operation, such as polytetrafluoroethylene, epoxy resins such as FR-4 and FR-1, HL972, CEM-1, CEM-3, Arlon 25N, GETEK, liquid crystal polymer (LCP), ceramics, Teflon, and the like. The depicted implementation of the substrate 210 may be fabricated from multiple printed circuit board (PCB) core layers aligned in the Z-plane and bonded using adhesive, heat, and pressure. To illustrate, in an implementation utilizing two intermediary metal layers 503, the top metal layer 214, one intermediary metal layer 503 and a dielectric layer may be formed as one PCB layer, the bottom metal layer 216, and the other intermediary metal layer 503 may be formed as a second PCB layer. The two PCB layers then may be aligned and bonded using a preimpregnated (prepreg) layer that forms a dielectric layer between the two intermediary metal layers.

As described above, the top metal layer 214 of the substrate 210 includes the signal line 314 extending between the via 318 to the launcher element 224 and the co-planar ground plane 316. The bottom metal layer 216 of the substrate 210 includes the signal line 414 extending between the via 318 and a bump 704 of the IC die 720, and the co-planar ground plane 416. Similarly, the intermediary layer 503 includes the ground plane 516. As illustrated in more detail in this view, the ground planes 316 and 516 are formed so as to provide the open regions 234 and 524, with the open region 234 surrounding and underlying the launcher 224 and the open region 536 surrounding the signal via 318.

As also illustrated, vias of the via fence 236 serve to electrically connect the various ground planes as well as to serve as a barrier for EM signaling emitted by the conductive components of the CPW structure 300. To illustrate, vias 706 and 708 are examples of the portion of the via fence 236 that substantially encircles the signal via 318 so as to form, in effect, a "wall" of vias that form a conductive "shield" to confine EM signaling emitted by the signal via 318, with the via 711 connecting the ground plane 316 and the ground plane 516, and the via 713 connecting the ground plane 516 and the ground plane 416. Similarly via 715 is an example of the portion of the via fence 236 formed at the perimeter 320 (FIG. 3) of the open region 234 and which serves to form, in effect, the "side walls" of the waveguide channel section 232 in the substrate 210, whereby the via 715 connects the ground plane 316 to the ground plane 416.

In the illustrated example, the via fence 236 includes one row or layers of vias for ease of illustration. However, in other embodiments, the via fence 236 can include two or more rows of vias. When the spacing between the metal vias of the via fence 236 are below approximately $1/10^{th}$ (10%) or $1/20^{th}$ (5%) of the guided wavelength $\lambda_g$ of the center frequency of the propagated signaling, the incident electromagnetic field interacts with the proximate section of the via fence 236 as though it were a wall of solid metal. Thus, in at least one embodiment, the metal vias of the via fence 236 are spaced from each other at a distance of not more than $1/10^{th}$ of the guided wavelength $\lambda_g$ of the center frequency $f_C$ of the propagated signaling so that the layers of vias may form an artificial metallic waveguide within the substrate 210. Thus, for a 60 GHz application, a spacing of the vias at 340 micrometers or less will permit the via fence 236 to effectively operate as an electromagnetic wall for the propagated signaling.

As depicted by the cross-section view 702, the RF circuit package 104, waveguide adapter plate 102, and antenna flange 108 of the horn antenna 106 are aligned and assembled together via flange bolts, such as flange bolt 705 (one embodiment of the flange bolts 110, 111, FIG. 2), extending through corresponding flange bolt holes in each of the antenna flange 108, waveguide adapter plate 102, and RF circuit package 104. This in turn provides accurate alignment of the waveguide channel section 232 in the RF circuit package 104, the waveguide channel section 240 in the waveguide adapter plate 102, and a waveguide channel section 706 in the antenna flange 108 so as to form, in effect, a sectioned waveguide channel 708 that extends substantially continuously from the ground plane portion 430 in the bottom metal layer 216 of the substrate 210, up through the waveguide adapter plate 102 and antenna flange 108, and into the interior 244 of the horn antenna 106. In this configuration, the launcher element 224 is inserted into the sectioned waveguide channel 708 through an aperture 710 formed by a groove 712 in the bottom surface 206 (FIG. 2) of the waveguide adapter plate 102 between the waveguide channel section 240 and the slot 288 (FIG. 2). Thus, the ground plane portion 430 of the ground plane 416 effectively serves as the back wall of the sectioned waveguide channel 708 and the vias of the via fence 236 at the perimeter of the open region 234 effectively serve as an initial section of the side walls of the sectioned waveguide channel 708, with the walls of the waveguide channel section 240 and the sectioned waveguide channel 708 forming the intermediary and final section of the side walls of the sectioned waveguide channel 708.

Thus, in an implementation of the antenna subassembly 101 as a transmit configuration, the IC die 420 receives data from a signal processing device via the electrical connector 122, converts this data to corresponding RF signaling at or near an intended center frequency $f_c$, and excites the launcher element 224 with the RF signaling via the CPW structure 300 (FIG. 3) to generate corresponding EM signaling emitted into the sectioned waveguide channel 708. This EM signaling is guided via the sectioned waveguide channel 708 to the interior 244 of the horn antenna 106. The horn antenna 106 in turn focuses the open-air propagation of the EM signaling in the direction in which the horn antenna 106 is aimed. Conversely, in an implementation of this configuration as a receive configuration, EM signaling is gathered by the horn antenna 106 and focused into the sectioned waveguide channel 708. The waveguide channel 708 guides the EM signaling to the launcher element 224, which results in RF signaling being generated on the CPW structure 300. The IC die 420 senses this RF signaling and converts it to the corresponding digital signal, which is provided to an external signal processing device via the electrical connector 122.

Typically, antenna designers attempt to space a launcher element a quarter-wavelength from the ground plane in a waveguide channel so as to provide the desired shorting effect at a specified center frequency. As the distance between the launcher element 224 and the ground plane portion 430 defines the distance between the launcher element 224 and the "back wall" of the resulting sectioned waveguide channel 708, the layers of the substrate 210 are fabricated to provide a precise specified distance between the launcher element 224 and the ground plane portion 430, and thus facilitate the desired quarter-wavelength spacing for grounding at a specified center frequency. As many semiconductor fabrication processes can control the layer dimensions of the substrate 210 to tight dimensional tolerances, the illustrated implementation permits the launcher 224 to be accurately located an appropriate distance from the effective "back wall" and "side walls" for an intended center frequency with reduced opportunity for fabrication error or assembly misalignment and thus more reliably providing the appropriate shorting between the probe element and the waveguide at the intended center frequency. To illustrate, as the launcher 224 is implemented in the top metal layer 214 and the ground plane portion 430 is implemented in the bottom metal layer 216 in this example, in at least one embodiment, the thickness of the layers of the substrate 210 are selected (in accordance with factory design rules) so that the resulting total, or combined, thickness of the substrate 210 provides a quarter-wavelength distance between the top metal layer 214 and the bottom metal layer 216. To illustrate, the guided wavelength $\lambda_g$ of a signal at a center frequency f is represented by the following equation:

$$\lambda_g = \frac{c}{f\sqrt{\varepsilon r}}$$

where c represents the speed of light, and ∈r represents the dielectric constant of the dielectric material. Accordingly, at a center frequency f=60 GHz and assuming a dielectric constant ∈r=2.16 for an organic dielectric material, the resulting quarter of the guided wavelength $\lambda_g$ is ¼ $\lambda_g$=850 micrometers, and thus the thicknesses of the of the metal layers and the organic core and prepreg dielectric layers disposed in between, may be selected (within factory design rules) to sum up to a total thickness of approximately 850 micrometers.

As further illustrated by cross-section view 702, the CPW structure 300 effectively utilizes coplanar waveguides formed from the signal lines 314 and 414 and corresponding coplanar ground planes 316 and 416, respectively, and the quasi-coaxial structure 312 implementing the signal via 318 to form an electrically continuous feedline extending between the RF bump 704 of the IC die 420 to the launcher 224 disposed in the sectioned waveguide channel 708. Further, the use of vias of the via fence 236 disposed along the perimeters of the ground planes proximal to these signal lines 314, 414, as well as the ring of vias substantially encircling the signal via 318, provides shielding at the operational RF frequency so as to effectively confine the EM signaling emitted by the signal lines 314 and 414 and the signal via 318 as they conduct RF signaling between the launcher 224 and the IC die 420.

Figure 8:
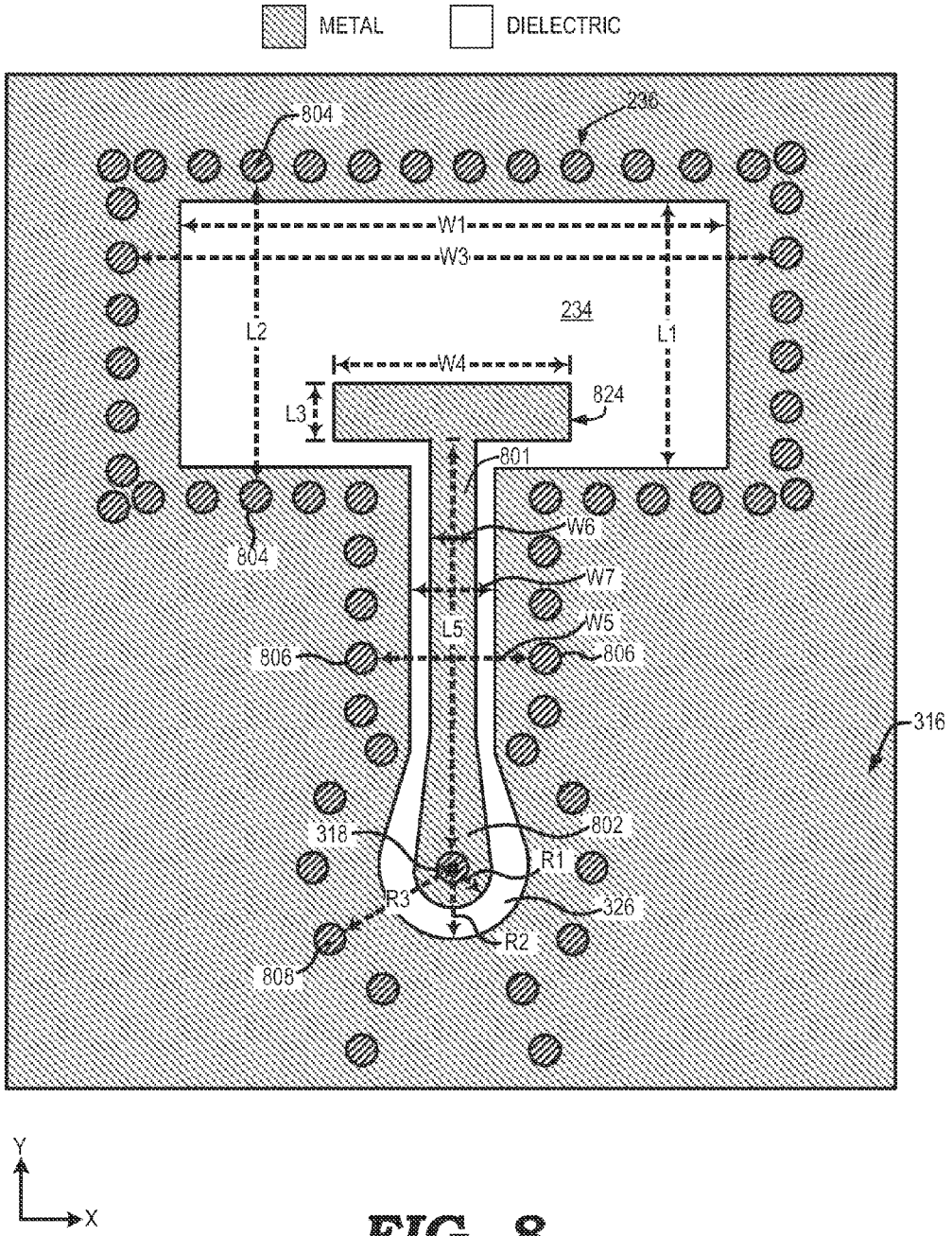
FIG. 8 is a plan view of a T-type coplanar waveguide (CPW) launcher and waveguide channel section of the RF IC package of the antenna subassembly of FIG. 2 in accordance with some embodiments.
Figure 9:
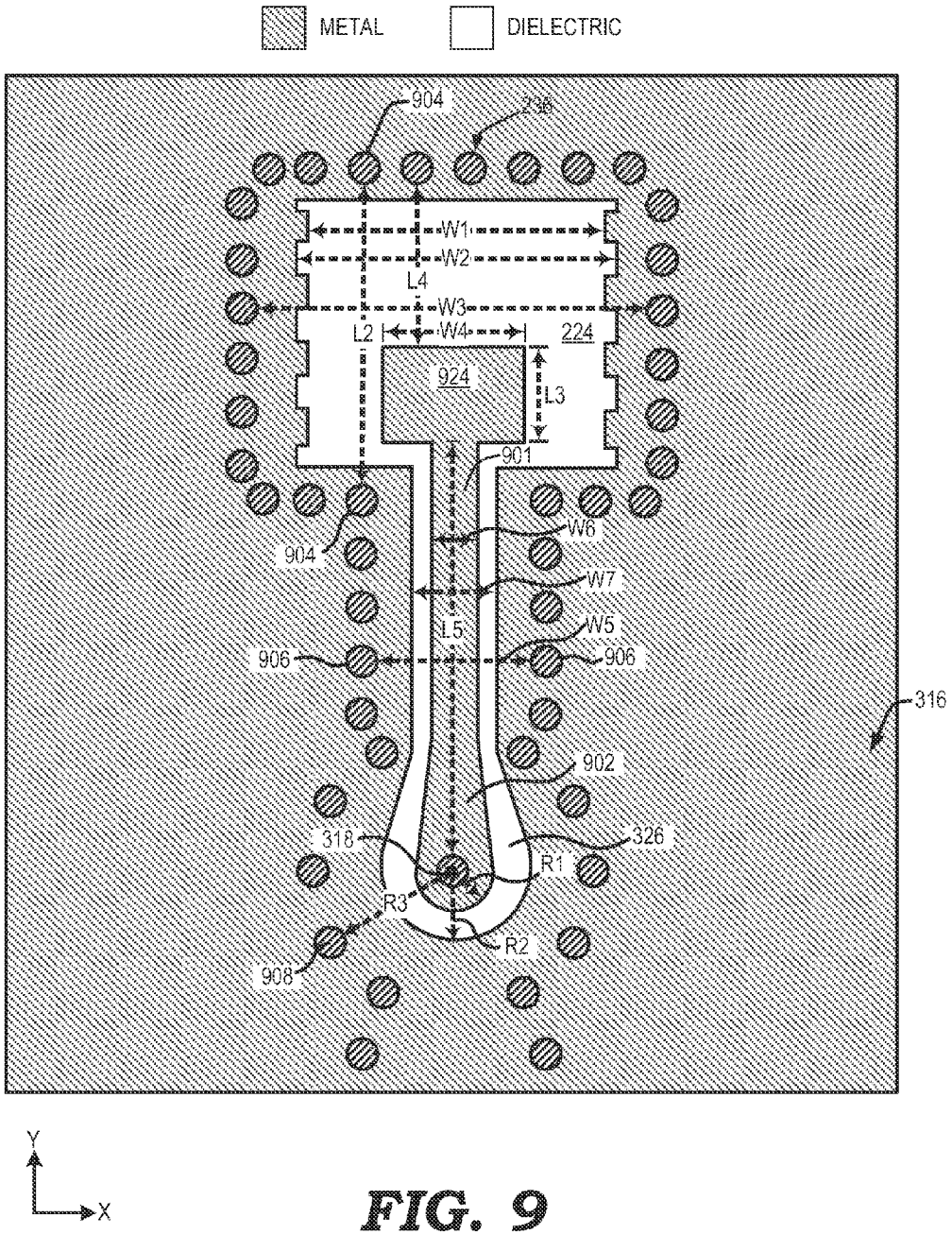
FIG. 9 is a plan view of a P-type coplanar waveguide (CPW) launcher and waveguide channel section of the RF IC package of the antenna subassembly of FIG. 2 in accordance with some embodiments.

FIGS. 8 and 9 illustrate a plan views of example implementations of the continuous conductive trace forming the launcher 224 and signal line 314, as well as a surrounding area of the top metal layer 214 (FIG. 3) of the substrate 210 of the RF circuit package 104 in accordance with at least one embodiment of the present disclosure.

Turning to the example of FIG. 8, the launcher element 224 is implemented as a T-type launcher element 824 connected to the signal line 314, which extends from the edge of the launcher element 824 to the signal via 318 of the CPW structure 300 (FIG. 3). The launcher element 824 extends into the open region 234 formed at least in part as a void in the ground plane 316. Likewise, the signal line 324 is positioned the open region 326, which is also formed as a void in the ground plane 316. In this example, and in the example of FIG. 9 discussed below, the signal via 318 includes a continuous-width section 801 and a taper segment 802, with the continuous-width section 801 extending from the launcher element 824 and the taper segment 802 extending from the end of the continuous-width section to the signal via 318, with an increasing width and a radius edge around the signal via 318. The launcher element 824 is formed as a substantially rectangular plane of conductive material with a width (identified as dimension W4 in FIG. 8) greater than the width of the continuous-width section 801 where it connects with the launcher element 824 and substantially greater than its length (identified as dimension L3 in FIG. 8). The via fence 236 includes sets of vias bordering the open regions 234 and 326, including one or more rows of vias 804 bordering the open region 234, one or more rows of vias 806 bordering the open region 326 along the continuous-width section 801, and one or more rows of vias 808 forming a ring that substantially encircles the signal via 318 and corresponding taper segment 802.

Turning to the example of FIG. 9, the launcher element 224 is implemented as a T-type launcher element 924 connected to the signal line 314, which extends from the edge of the launcher element 924 to the signal via 318 of the CPW structure 300 (FIG. 3) via a continuous-width section 901 and a taper segment 902 as similarly described above. The launcher element 924 is formed as a substantially rectangular plane of conductive material with a more equal width and length than the T-type launcher element 824 of FIG. 8. In the example of FIG. 9, the via fence 236 includes sets of vias bordering the open regions 234 and 326, including one or more rows of vias 904 bordering the open region 234, one or more rows of vias 906 bordering the open region 326 along the continuous-width section 901, and one or more rows of vias 908 forming a ring that substantially encircles the signal via 318 and corresponding taper segment 902.

In either of the implementation of FIG. 8 or the implementation of FIG. 9, one or more edges of the ground plane 316 defining the open region 234 may be corrugated, such as illustrated by the side edges of the open region 234 as illustrated in the implementation of FIG. 9. These corrugated edges serve to reduce undesired resonances in the EM signaling emitted by the launcher element. Further, for both the T-type and P-type launcher element configurations, the segments 801, 802 and segments 901, 902 of the signal line 314 typically are dimensioned so as to provide a characteristic impedance of 50Ω for impedance matching purposes and to provide a smooth transition leading to the respective launcher elements 824, 924. The launcher elements 824, 924 typically are dimensioned so as provide suitable waveguide excitation at the intended center frequency band. Table 1 below provides example dimensions found by the inventors to be well-suited for a 60 GHz signal application:

TABLE 1

| P-type Parameters (FIG. 9) | Value (mm) | T-type Parameters (FIG. 8) | Value (mm) |
|---|---|---|---|
| L1 | 1.7 | L1 | 1.245 |
| L2 | 2.07 | L2 | 1.4 |
| L3 | 0.53 | L3 | 0.27 |
| L4 | 1.0 | W1 | 2.55 |
| L5 | 0.56 | W3 | 2.95 |
| W1 | 2.02 | W4 | 0.95 |
| W2 | 2.15 | W5 | 0.7 |
| W3 | 3.16 | W6 | 0.216 |
| W4 | 0.95 | W7 | 0.4 |
| W5 | 0.7 | R1 | 0.185 |
| R1 | 0.14 | R2 | 0.355 |
| R2 | 0.3 | R3 | 0.57 |
| R3 | 0.5 | | |

It will be appreciated by those skilled in the art that this combination of design parameters is just one example set of design parameters, and other design parameters may be implemented to achieve similar results for other implementations.

Figure 10:
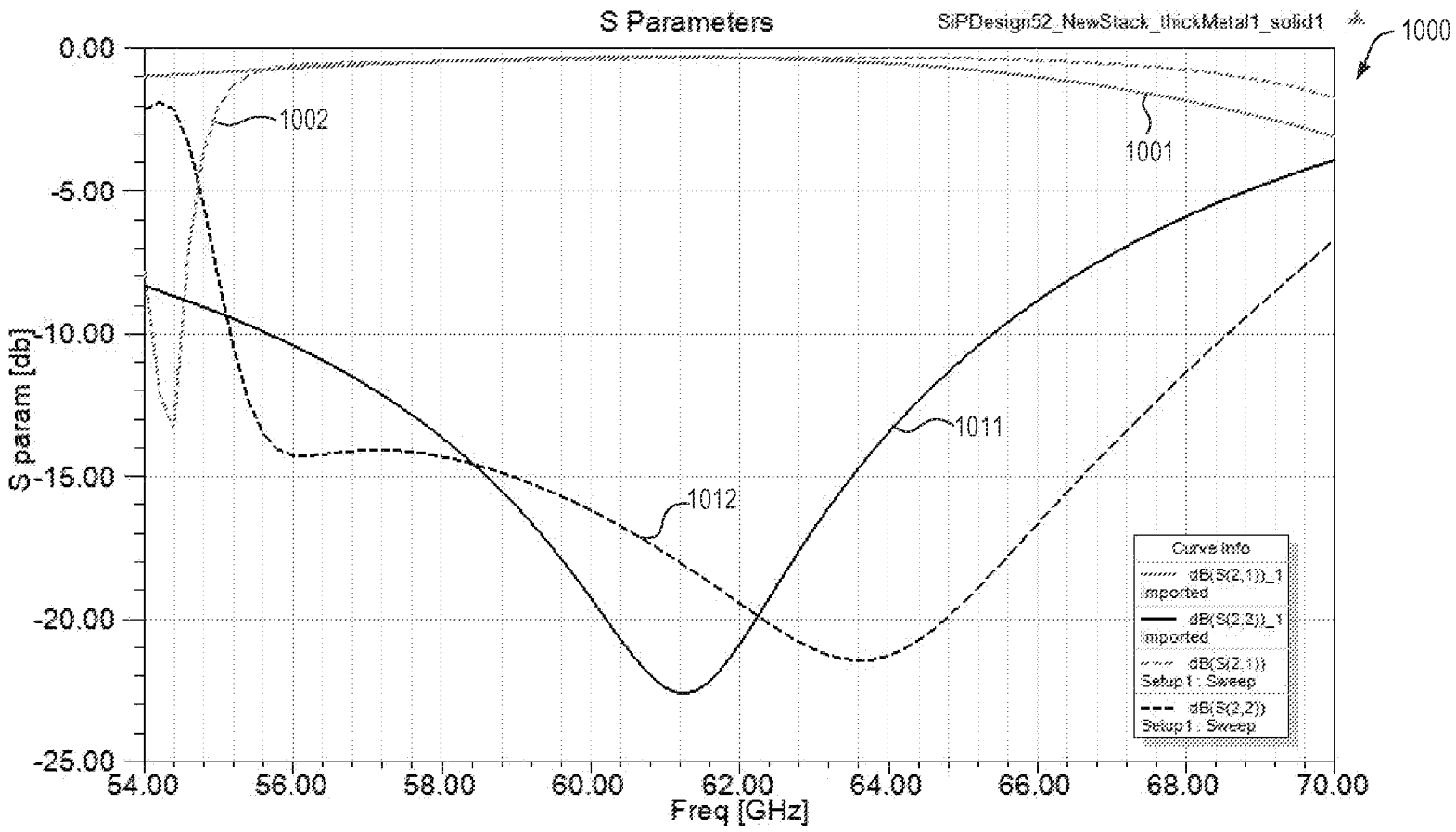
FIG. 10 is a chart illustrating measured operational scatter parameters of implementations of the RF IC package of the antenna subassembly of FIG. 2 using the T-type and P-type CPW launchers of FIGS. 8 and 9, respectively, in accordance with some embodiments of the present disclosure.

FIG. 10 illustrates a charts 1000 illustrating scattering parameters ("S parameters") simulated in a test implementation of the microwave antenna assembly 100 fabricated for 60 GHz signaling in accordance with the teachings and specifications described above. Lines 1001 and 1002 of chart 1000 illustrate the measured insertion loss parameters (often referred to as the S21 parameter) for the T-type launcher implementation (FIG. 8) and the P-type launcher implementation (FIG. 9), respectively, over a frequency spectrum from 54 GHz to 70 GHz. As illustrated by lines 1001 and 1002, the P-type launcher implementation exhibits lower loss than the T-type launcher, but exhibits a sharp drop at approximately 54.5 GHz, while the T-type launcher has a relatively smooth and reliable behavior. Lines 1011 and 1012 of chart 1000 illustrate the measured return loss (often referred to as the S11 parameter) for the T-type and P-type launcher implementations, respectively. As illustrated by line lines 1011 and 1012, the P-type launcher implementation exhibits a wider bandwidth of 13.4 GHz, compared to the bandwidth of approximately 10 GHz for the T-type launcher implementation.

In this document, relational terms such as first and second, and the like, may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element. The term "another", as used herein, is defined as at least a second or more. The terms "including" and/or "having", as used herein, are defined as comprising. The term "coupled", as used herein with reference to electro-optical technology, is defined as connected, although not necessarily directly, and not necessarily mechanically.

The specification and drawings should be considered as examples only, and the scope of the disclosure is accordingly intended to be limited only by the following claims and equivalents thereof. Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. An apparatus comprising:

an integrated circuit (IC) package comprising:

an IC die disposed at a first surface of a substrate, the IC die comprising radio frequency (RF) circuitry; and the substrate, wherein the substrate comprises:

a signal via extending between first and second metal layers of the substrate;

the first metal layer proximate to the first surface and comprising a first coplanar waveguide, the first coplanar waveguide having a first signal line coupling a bump of the IC die to the signal via and having a first ground plane co-planar with the first signal line;

the second metal layer proximate to a second surface of the substrate and comprising a second coplanar waveguide, the second coplanar waveguide having a second signal line coupling the signal via to a launcher element and having a second ground plane co-planar with the second signal line;

a waveguide channel aperture comprising a first region surrounding the launcher element, the first region substantially devoid of conductive material;

a via fence comprising metal vias disposed at a perimeter of the first region and extending between the first ground plane and the second ground plane;

a third metal layer disposed between the first metal layer and the second metal layer, the third metal layer comprising a second waveguide channel aperture comprising a second region aligned with the first region, the second region being substantially devoid of conductive material; and wherein the third metal layer implements signal line routing for circuit components of the IC package.

2. The apparatus of claim 1, wherein:

the substrate further comprises a second region surrounding the signal via, the second region being substantially devoid of conductive material; and the via fence further comprises metal vias disposed at a perimeter of the second region and extending from the first ground plane to the second ground plane.

3. The apparatus of claim 2, wherein the via fence further comprises:

metal vias disposed at a perimeter of the first ground plane that is adjacent to the first signal line and extending from the first ground plane to the second ground plane.

4. The apparatus of claim 3, wherein the via fence further comprises:

metal vias disposed at a perimeter of the second ground plane that is adjacent to the second signal line and extending from the first ground plane to the second ground plane.

5. The apparatus of claim 1, wherein:

the RF circuitry is configured to communicate RF signaling; and the metal vias of the via fence are spaced from each other at a distance not greater than 10% of a wavelength of a center frequency of a bandwidth of the RF signaling.

6. The apparatus of claim 1, wherein the first signal line is oriented 180 degrees relative to the second signal line.

7. The apparatus of claim 1, further comprising:

a waveguide adapter plate attached to the IC package, the waveguide adapter plate comprising:

a third surface and an opposing fourth surface, the third surface facing the second surface of the substrate; and a waveguide channel section extending from third surface to the fourth surface, the waveguide channel section having a waveguide channel aperture at the third surface that is aligned with the waveguide channel aperture of the substrate.

8. The apparatus of claim 7, further comprising:

an antenna comprising an antenna flange attached at the fourth surface of the waveguide adapter plate, the antenna flange having a fifth surface facing the fourth surface and an opposing sixth surface, and further having a waveguide channel section aligned with the waveguide channel section of the waveguide adapter plate.

9. The apparatus of claim 8, wherein the IC package, the waveguide adapter plate, and waveguide flange are attached via a set of bolts extending from the first surface of the IC package to the sixth surface of the waveguide flange via aligned bolt holes in each of the IC package, the waveguide adapter plate, and the waveguide flange.

10. A method of fabricating an antenna apparatus, the method comprising:

fabricating an integrated circuit (IC) package, the IC package comprising:

an IC die disposed at a first surface of a substrate, the IC die comprising radio frequency (RF) circuitry; and the substrate, wherein the substrate comprises:

a signal via extending between first and second metal layers of the substrate;

the first metal layer proximate to the first surface and comprising a first coplanar waveguide, the first coplanar waveguide having a first signal line coupling a bump of the IC die to the signal via and having a first ground plane co-planar with the first signal line;

the second metal layer proximate to a second surface of the substrate and comprising a second coplanar waveguide, the second coplanar waveguide having a second signal line coupling the signal via to a launcher element and having a second ground plane co-planar with the second signal line;

a waveguide channel aperture comprising a first region surrounding the launcher element, the first region being substantially devoid of conductive material;

a via fence comprising metal vias disposed at a perimeter of the first region and extending from the first ground plane to the second ground plane;

a third metal layer disposed between the first metal layer and the second metal layer, the third metal layer comprising a second waveguide channel aperture comprising a second region aligned with the first region, the second region being substantially devoid of conductive material, and wherein the third metal layer implements signal line routing for circuit components of the IC package.

11. The method of claim 10, wherein fabricating the IC package further comprises:

fabricating the substrate to include a second region surrounding the signal via, the second region being substantially devoid of conductive material; and fabricating the via fence to include metal vias disposed at a perimeter of the second region and extending from the first ground plane to the second ground plane.

12. The method of claim 11, wherein fabricating the via fence further comprises fabricating the via fence to further include metal vias disposed at a perimeter of the first ground plane that is adjacent to the first signal line and extending from the first ground plane to the second ground plane.

13. The method of claim 10, further comprising:

fabricating a waveguide adapter plate attachable to the IC package, the waveguide adapter plate comprising:

a third surface and an opposing fourth surface, the third surface to face the second surface of the substrate; and a waveguide channel section extending from third surface to the fourth surface, the waveguide channel section having a waveguide channel aperture at the third surface to align with the waveguide channel aperture of the substrate.

14. The method of claim 13, further comprising:

mounting an antenna flange to the waveguide adapter plate at the fourth surface, the antenna flange having a fifth surface to face the fourth surface and an opposing sixth surface, and further having a waveguide channel section to align with the waveguide channel section of the waveguide adapter plate.

15. The method of claim 14, further comprising:

attaching the IC package, the waveguide adapter plate, and waveguide flange via a set of bolts extending from the first surface of the IC package to the sixth surface of the waveguide flange via aligned holes in each of the IC package, the waveguide adapter plate, and the waveguide flange.

16. The method of claim 10, wherein:

the RF circuitry is configured to communicate RF signaling; and the metal vias of the via fence are spaced from each other at a distance not greater than 10% of a wavelength of a center frequency of a bandwidth of the RF signaling.

* * * * *